US010683835B2

(12) United States Patent
Saso et al.

(10) Patent No.: US 10,683,835 B2
(45) Date of Patent: Jun. 16, 2020

(54) HIGH-PRESSURE FUEL SUPPLY PUMP

(71) Applicant: Hitachi Automotive Systems, Ltd., Hitachinaka-shi, Ibaraki (JP)

(72) Inventors: Yuta Saso, Hitachinaka (JP); Atsuji Saito, Hitachinaka (JP); Satoshi Usui, Hitachinaka (JP); Shingo Tamura, Hitachinaka (JP); Moritsugu Akiyama, Hitachinaka (JP); Hiroyuki Yamada, Hitachinaka (JP); Atsushi Hohkita, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 16/449,771

(22) Filed: Jun. 24, 2019

(65) Prior Publication Data

US 2019/0309715 A1 Oct. 10, 2019

Related U.S. Application Data

(63) Continuation of application No. 15/105,973, filed as application No. PCT/JP2014/080289 on Nov. 17, 2014, now Pat. No. 10,371,109.

(30) Foreign Application Priority Data

Dec. 27, 2013 (JP) ..... 2013-270802

(51) Int. Cl.
*F02M 59/44* (2006.01)
*F04B 49/24* (2006.01)
(Continued)

(52) U.S. Cl.
CPC ..... *F02M 59/447* (2013.01); *F02M 59/44* (2013.01); *F02M 59/46* (2013.01);
(Continued)

(58) Field of Classification Search
CPC ..... F02M 59/447; F02M 59/46; F02M 59/44; F02M 59/48; F02M 2200/8061;
(Continued)

(56) References Cited

U.S. PATENT DOCUMENTS 10,371,109 B2 * 8/2019 Saso ..... F04B 53/16
10,378,524 B2 * 8/2019 Saito ..... F04B 53/16
(Continued)

FOREIGN PATENT DOCUMENTS

EP 1 788 231 B1 2/2010
EP 2 434 137 A1 3/2012
(Continued)

OTHER PUBLICATIONS

International Search Report (PCT/ISA/210) issued in PCT Application No. CT/JP2014/080289 dated Mar. 3, 2015 with English translation (Four (4) pages).
(Continued)

*Primary Examiner* — Charles G Freay
(74) *Attorney, Agent, or Firm* — Crowell & Moring LLP

(57) ABSTRACT

A fuel pump includes an electromagnetically driven intake valve mechanism, a pump housing, a discharge valve, an opening, a seal member, and a first relief passage. The relief valve mechanism has a relief valve, a relief valve seat contacting the relief valve when the relief valve is closed and a relief spring biasing the relief valve against the relief valve seat. A second relief passage, communicating the first relief passage and a hole formed in the relief seat, is formed between the seal member and the relief valve seat. The relief valve seat, the relief valve, and the relief spring are arranged in this order beginning from the open end side.

5 Claims, 7 Drawing Sheets

(51) Int. Cl.

| | |
|---|---|
| ***F02M 59/46*** | (2006.01) |
| ***F02M 59/48*** | (2006.01) |
| ***F04B 53/16*** | (2006.01) |
| *F02M 59/36* | (2006.01) |
| *F02M 59/02* | (2006.01) |

(52) U.S. Cl.
CPC ..... *F02M 59/48* (2013.01); *F04B 49/24* (2013.01); *F04B 53/16* (2013.01); *F02M 59/025* (2013.01); *F02M 59/368* (2013.01); *F02M 59/462* (2013.01); *F02M 2200/8061* (2013.01)

(58) Field of Classification Search
CPC .. F02M 59/462; F02M 59/025; F02M 59/368; F04B 49/24; F04B 53/16
See application file for complete search history.

(56) References Cited

U.S. PATENT DOCUMENTS

| | | | | |
|---|---|---|---|---|
| 2007/0110603 | A1 | 5/2007 | Usui et al. | |
| 2008/0056914 | A1 | 3/2008 | Usui et al. | |
| 2009/0116976 | A1 | 5/2009 | Aritomi et al. | |
| 2009/0252621 | A1 | 10/2009 | Siegel et al. | |
| 2011/0125387 | A1 | 5/2011 | Suzuki et al. | |
| 2011/0139126 | A1* | 6/2011 | Inoue | F02M 59/46 123/506 |
| 2011/0315909 | A1* | 12/2011 | Oikawa | F02M 55/025 251/337 |
| 2012/0118269 | A1 | 5/2012 | Ferry et al. | |
| 2012/0251365 | A1 | 10/2012 | Ono | |
| 2012/0312278 | A1 | 12/2012 | Usui et al. | |

FOREIGN PATENT DOCUMENTS

| | | | |
|---|---|---|---|
| EP | 2 541 039 | A1 | 1/2013 |
| EP | 3088725 | * | 2/2016 |
| JP | 2003-247474 | A | 9/2003 |
| JP | 2004-138062 | A | 5/2004 |
| JP | 2007-138762 | A | 6/2007 |
| JP | 2008-57451 | A | 3/2008 |
| JP | 2008-64013 | A | 3/2008 |
| JP | 2008057451 | * | 3/2008 |
| JP | 2009-114868 | A | 5/2009 |
| JP | 2009-534582 | A | 9/2009 |
| JP | 2009-257197 | A | 11/2009 |
| JP | 2010-174903 | A | 8/2010 |
| JP | 2011-132941 | A | 7/2011 |
| JP | 2011-179319 | A | 9/2011 |
| JP | 2012-158990 | A | 8/2012 |
| JP | 2012-207632 | A | 10/2012 |
| JP | 2013-167259 | A | 8/2013 |

OTHER PUBLICATIONS

Japanese-language Written Opinion (PCT/ISA/237) issued in PCT Application No. CT/JP2014/080289 dated Mar. 3, 2015 (Seven (7) pages).

Japanese Office Action issued in counterpart Japanese Application No. 2015-554675 dated Dec. 20, 2016 with English-language translation (ten (10) pages).

Japanese-language Office Action issued in counterpart Japanese Application No. 2015-554675 dated Feb. 14, 2017 with English translation (Ten (10) pages).

Unverified English translation of document B16 (JP 2013-167259 A) previously filed on Feb. 15, 2017 (Thirty (30) pages).

* cited by examiner

HIGH-PRESSURE FUEL SUPPLY PUMP

CROSS REFERENCE TO RELATED APPLICATIONS

This application is a continuation of U.S. application Ser. No. 15/105,973, filed Jun. 17, 2016, which is a National Stage of PCT/JP2014/080289, filed Nov. 17, 2014, which claims priority from Japanese Patent application No. 2013-270802, filed on Dec. 27, 2013, the disclosures of which are expressly incorporated by reference herein.

TECHNICAL FIELD

The present invention relates to a high-pressure fuel supply pump suitable for being preferably used in a fuel supply system of an internal combustion engine having a high-pressure fuel ejection valve configured to inject fuel directly into a cylinder.

BACKGROUND ART

A conventional high-pressure fuel supply pump described in Japanese Patent Laid-Open No. 2004-138062 includes a relief valve mechanism, in which when a fuel thermally expands due to a malfunction of a flow rate control mechanism of an intake valve and a discharge valve or an increase in a temperature of a piping and the like and a pressure in a high-pressure fuel capacity chamber attains an abnormally high pressure, the pressure in the high-pressure fuel capacity chamber is reduced to a predetermined pressure or less, so that the high-pressure fuel injection valve, the piping, and the like are prevented from malfunctioning.

This relief valve mechanism s configured such that a ball valve is pressed onto a relief seat with a biasing force of a spring, and the fuel flows only in one direction from a downstream side to an upstream side of a discharge valve. When a pressure at a downstream side of an output valve becomes more than a set pressure determined by a set load of the spring, the fuel is relieved to the upstream side of the discharge valve. Further, the relief valve mechanism is fixed to a relief path connecting the upstream side of the discharge valve and the downstream side of the discharge valve, and is inserted in an orientation from the upstream side of the discharge valve to the downstream side of the discharge valve.

CITATION LIST

Patent Literature

PTL 1: Publication of 2004-138062

SUMMARY OF INVENTION

Technical Problem

The relief valve mechanism has a problem in that, due to a differential pressure generated when the pressure of the inlet side pressure of the relief valve mechanism (downstream of the discharge valve) becomes a high pressure, and the outlet side pressure (upstream of the discharge valve) becomes a low pressure, a force for pushing out the relief valve mechanism is exerted is a direction opposite to the outlet side of the relief valve mechanism (upstream of the discharge valve), i.e., a direction in which the relief valve mechanism is inserted, so that the relief valve mechanism is detached.

Therefore, there is a problem in that a load is applied to a welding portion fixing the relief valve mechanism, so that the welding portion is likely to be destroyed, and this causes the relief valve mechanism to be detached and causes the fuel to be leaked.

Accordingly, it is an object of the present invention to enhance the reliability of the relief valve mechanism made into a unit.

Solution to Problem

For example, the above object can be solved by improving an insertion direction and restriction of the relief valve mechanism made into a unit.

Advantageous Effects of Invention

According to the present invention, the reliability of the relief valve mechanism made into a unit can be enhanced.

DESCRIPTION OF EMBODIMENTS

Figure 1:
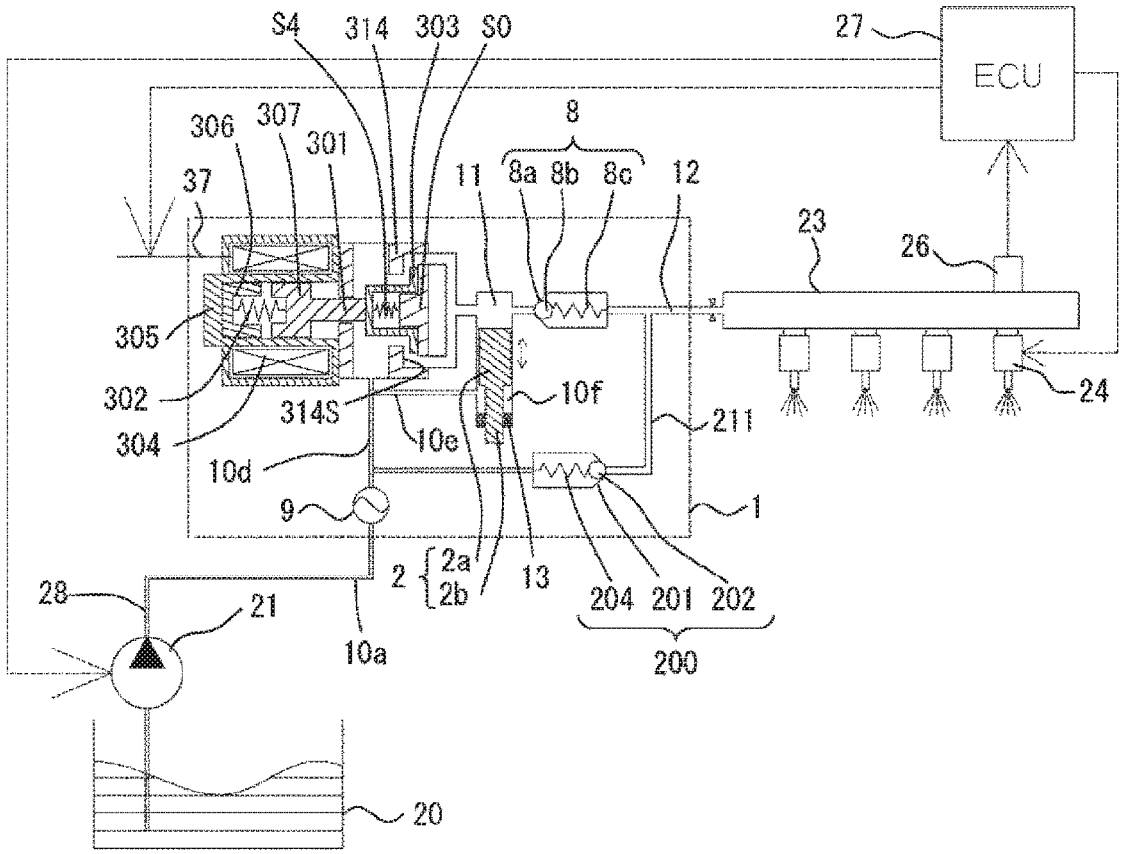
FIG. 1 is an example of a fuel supply system using a high-pressure fuel supply pump according to a first embodiment in which the present invention is carried out.

Hereinafter, the present invention will be explained on the basis of embodiments shown in the drawings.

First Embodiment

The first embodiment will be explained on the basis of FIG. 1 to FIGS. 6A and 6B.

A pump housing 1 is provided with a cup-shaped depression 11A for forming a compression chamber 11. A cylinder 6 is fitted into an opening of the depression 11A (compression chamber 11). An end portion of the cylinder 6 is pressed against a shouldered portion 16A provided at an opening of the compression chamber 11 of the pump housing 1 by a holder 7 by screwing the holder 7 at a screw portion 1*b*.

The cylinder 6 and the pump housing 1 are brought into press contact with each other at the shouldered portion 16A, and a fuel seal portion on the basis of metal contact is formed. The cylinder 6 is provided with a through hole (also referred to as a sliding hole) of a plunger 2 at the center thereof. The plunger 2 is loosely fitted into a through hole of the cylinder 6 so as to allow a reciprocal movement. A seal ring 62 is fitted on the outer periphery of the holder 7 at a position on the side of the compression chamber 11. The seal ring 62 forms a seal portion between the outer periphery of the holder 7 and an inner peripheral wall of the depression 11A of the pump housing 1 so as to prevent fuel from leaking.

A double cylindrical portion including an inner cylindrical portion 71 and an outer cylindrical portion 72 is formed on a side of the holder 7 opposite to the cylinder 6. A plunger seal apparatus 13 is held in the inner cylindrical portion 71 of the holder 7, and the plunger seal apparatus 13 is formed with a fuel trap portion 67 between an inner periphery of the holder 7 and a peripheral surface of the plunger 2. The fuel trap portion 67 traps fuel leaking from the sliding surface between the plunger 2 and the cylinder 6.

The plunger seal apparatus 13 prevents lubricating oil from entering into the fuel trap 67 from the side of a cam 5, described later.

The outer cylindrical portion 72 formed on the side of the holder 7 opposite to the cylinder 6 is inserted into a mounting hole 100A formed on an engine block 100. A seal ring 61 is mounted on an outer periphery of an annular projection 11B of the pump housing 1. The seal ring 61 prevents the lubricating oil from leaking from the mounting hole 100A into the atmosphere, and prevents water from entering from the atmosphere.

The high-pressure fuel supply pump is secured to the engine by means of a flange 41 integrally formed with the housing and a bolt 42. The bolts 42 are respectively screwed into the screws formed at the engine side, and by pressing the flange 41 into contact with the engine, the high-pressure fuel supply pump is fixed with the engine.

A lower end surface 101A of the pump housing 1 is in contact with a flat surface 100B around at mounting hole 100A of the engine block. The annular projection 11B is formed at a central portion of the lower end surface 101A of the pump housing 1.

The plunger 2 is formed so that the diameter of the small diameter portion 2*b* extending from the cylinder in a direction of the side opposite to the compression chamber is formed to be smaller than the diameter of the large diameter portion 2*a* slidably coupled with the cylinder 6. As a result, the external diameter of the plunger seal apparatus 13 can be reduced, and with this portion, a space for forming the double cylindrical portions 71, 72 can be ensured in the holder 7. With a retainer holder 16, a retainer 15 is fixed to the end portion of the small diameter portion 2*b* of the plunger 2 of which diameter is narrow. A spring 4 is provided between the holder 7 and the retainer 15.

One end of the spring 4 is attached to the inside of the outer cylindrical portion 72 around the inner cylindrical portion 71 of the holder 7. The other end of the spring 4 is arranged inside of the retainer 15 in a cylindrical shape having a bottom and made of metal. The cylindrical portion 31A of the retainer 15 is freely fit in the inner peripheral portion of the mounting hole 100A.

A lower end portion 21A of the plunger 2 is in contact with the inner surface of a bottom portion 31B of a tappet 3. A rotation roller 3A is attached to the central portion of the bottom portion 31B of the tappet 3. The roller 3A is pressed against the surface of the cam 5 by receiving the force of the spring 4. As a result, when the cam 5 rotates, the tappet 3 and the plunger 2 reciprocally move up and down along the profile of the cam 5. When the plunger 2 reciprocally moves, a compression chamber side end portion 2B of the plunger 2 moves into and moves out of the compression chamber 11. When the compression chamber side end portion 2B of the plunger 2 moves into the compression chamber 11, fuel in the compression chamber 11 is pressurized to a high pressure, and is discharged to a high-pressure passage. When the compression chamber side end portion 2B of the plunger 2 retracts from the compression chamber 11, fuel is taken into the compression chamber 11 through an intake path 30*a*. The cam 5 is rotated by a crankshaft or an overhead camshaft of an engine.

Figure 3:
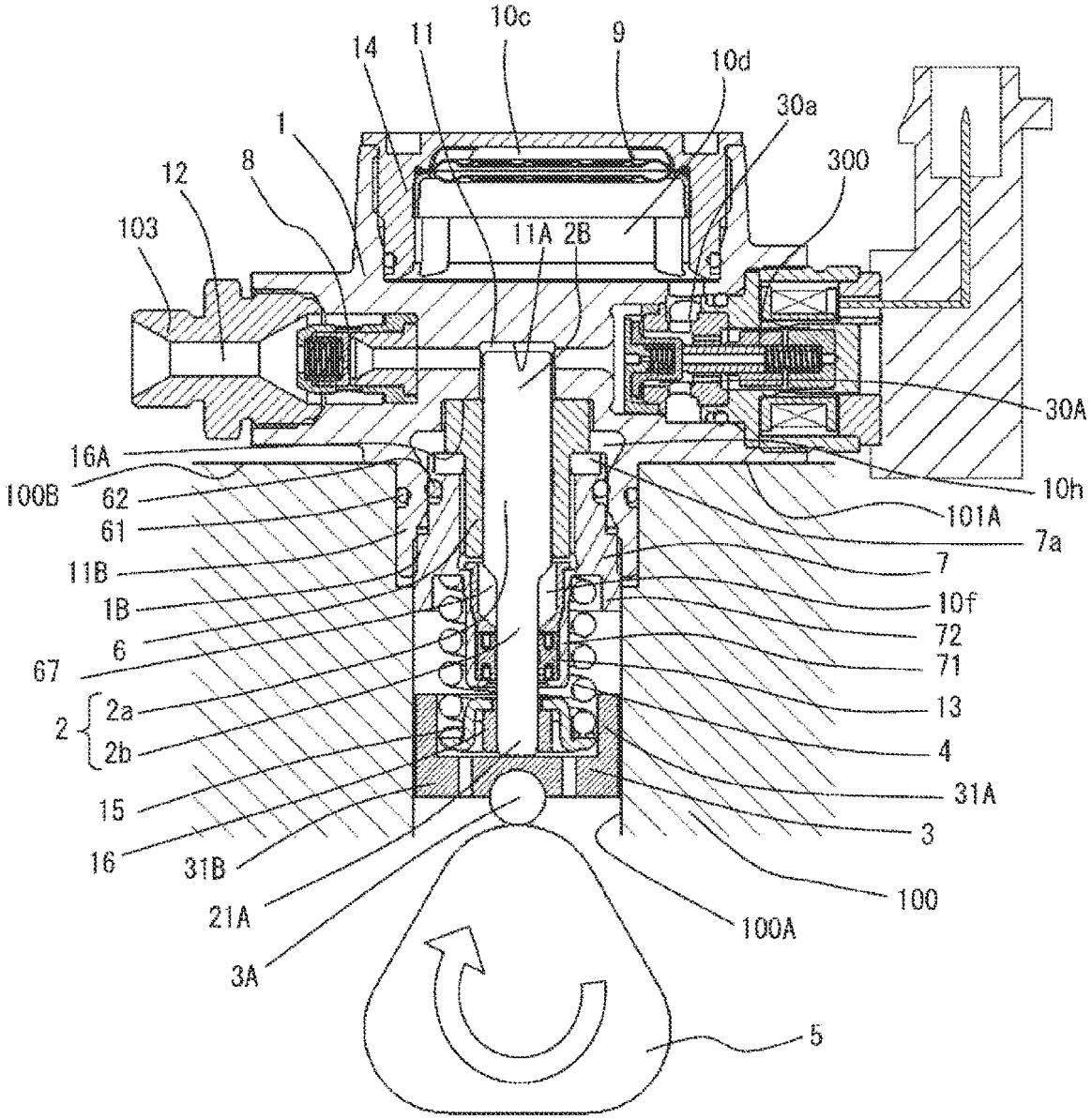
FIG. 3 is an entire longitudinal sectional view illustrating a high-pressure fuel supply pump according to the first embodiment in which the present invention is carried out.
Figure 4:
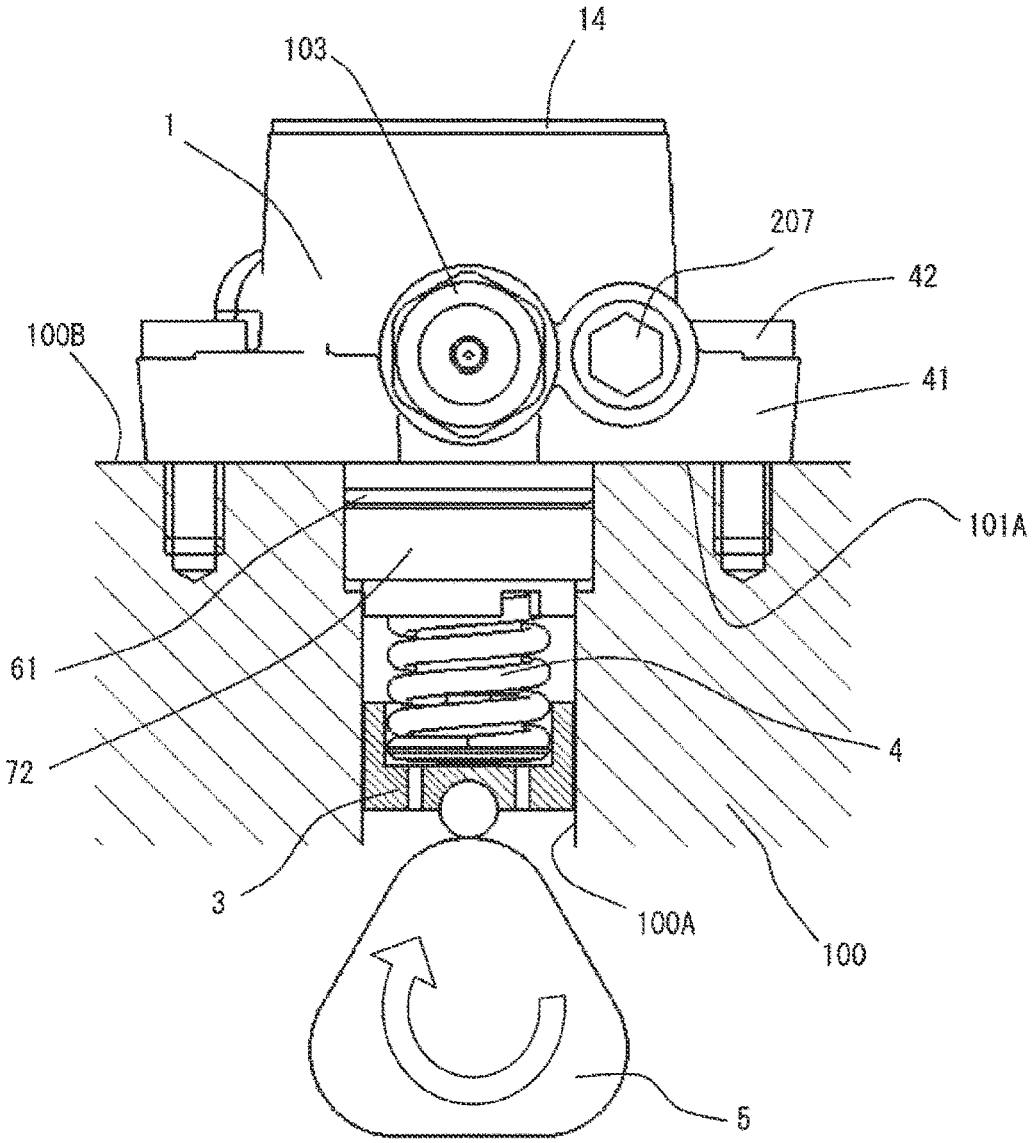
FIG. 4 is an external view illustrating a state in which the high-pressure fuel supply pump according to the first and the second embodiment in which the present invention is carried out is attached to an engine.
Figure 5:
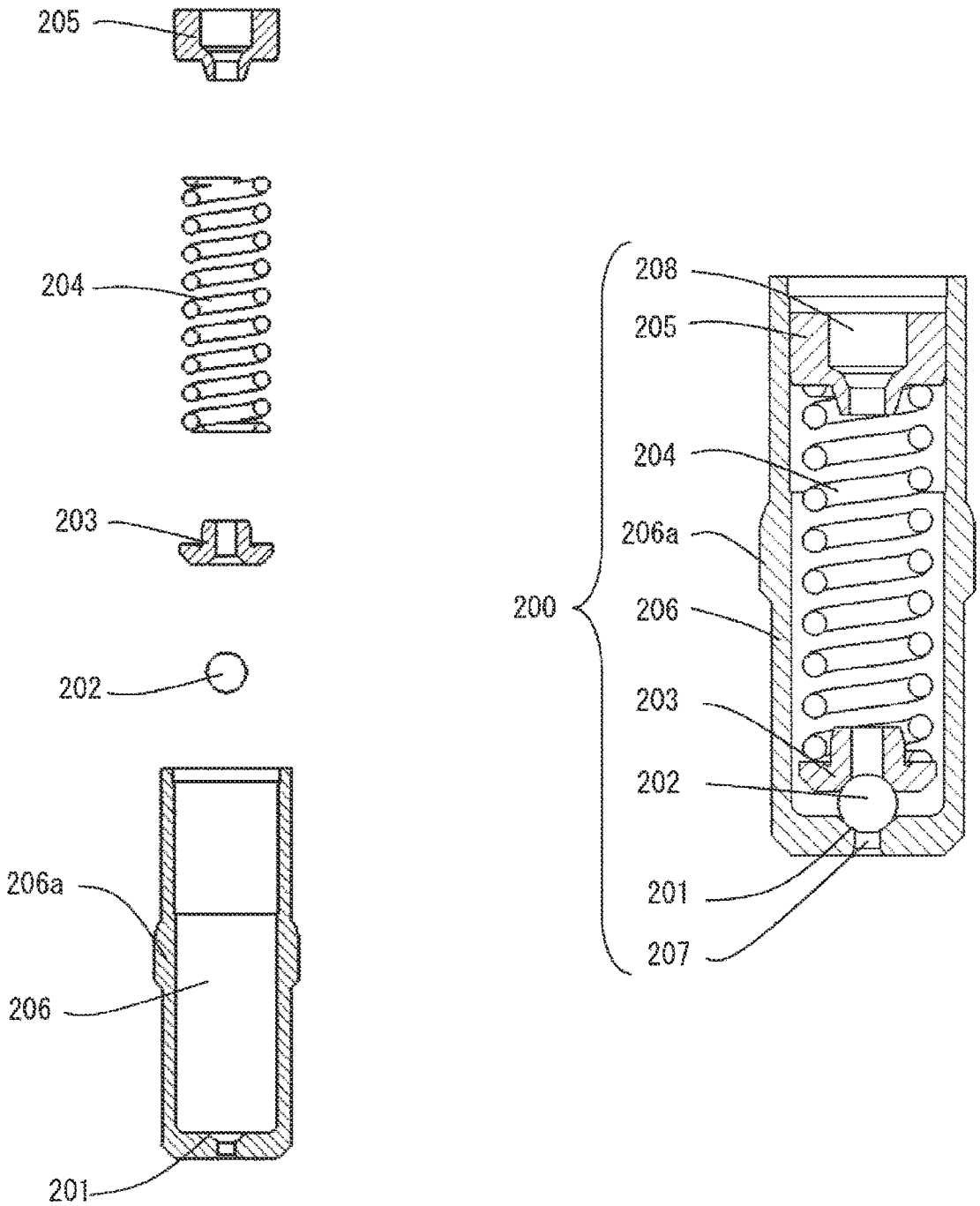
FIG. 5 is a figure for explaining a relief valve mechanism used for the first and the second embodiment in which the present invention is carried out.

When the cam 5 may not only be a three-lobe cam (having three lobes) as illustrated in FIG. 3 but also be a two-lobe cam or a four-lobe cam.

A damper cover 14 is fixed to the pump housing 1, and a pressure pulsation reducing mechanisms 9 for reducing fuel pressure pulsation is stored in low-pressure chambers 10*c*, 10*d* formed between the damper cover 14 and the pump housing 1 in compartments.

The low-pressure chambers 10*c*, 10*d* are provided on both the upper and lower surfaces of the pressure pulsation reducing mechanism 9, respectively.

The damper cover 14 has a function to form the low-pressure chambers 10*c*, 10*d* for storing the pressure pulsation reducing mechanism 9.

Figure 2:
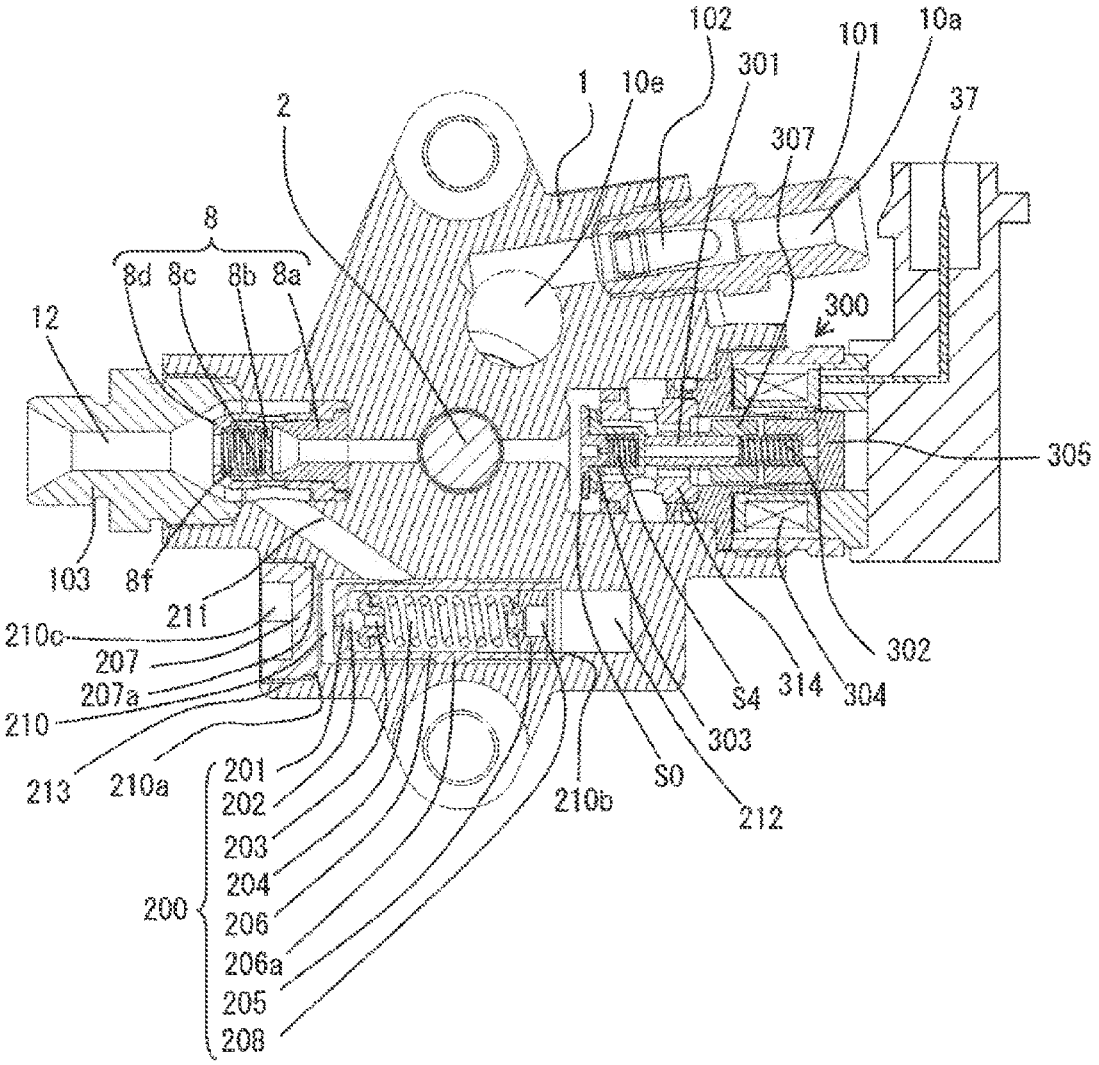
FIG. 2 is an entire transverse sectional view illustrating a high-pressure fuel supply pump of the first embodiment in which the present invention is carried out.

A discharge port 12 shown in FIG. 2 is defined by a joint 103 fixed to the pump housing 1 by a screw or welding.

The high-pressure fuel supply pump according to the first embodiment has a fuel passage configuration that extends from the low-pressure fuel port 10*a* of the joint 101, then to a low-pressure fuel passage 10*e*, the low-pressure chamber 10*d*, the intake path 30*a*, the compression chamber 11, and the discharge port 12. The low-pressure chamber 10*d*, the low-pressure fuel passage 10*e*, an annular low-pressure passage 10*h*, a groove 7*a* formed on the holder 7, the fuel trap portion 67 (annular low-pressure chamber 10*f*) are in communication. Consequently, when the plunger 2 reciprocates, the capacity of the fuel trap portion 67 (the annular low-pressure chamber 10*f*) increases and decreases, and the fuel comes and goes between the low-pressure chamber 10*d* and the fuel trap portion. 67 (the annular low-pressure chamber 10*f*). Accordingly, heat of the fuel in the fuel trap portion 67 (the annular low-pressure chamber 10*f*) heated by sliding heat generated by the plunger and 2 and the cylinder 6 is exchanged with respect to the fuel in the low-pressure chamber 10*d* and hence is cooled.

The electromagnetically driven intake valve mechanism 300 includes an electromagnetically driven plunger rod 301. A valve 303 is provided at a tip end of the plunger rod 301 and opposed to a valve seat 314S formed on a valve housing 314. The valve housing 314 is provided at an end portion of electromagnetically driven intake valve mechanism 300.

A plunger rod biasing spring 302 is provided at the other end of the plunger rod 301 and biases the plunger rod in a direction in which the valve 303 moves farther away from the valve seat 314S. A valve stopper S0 is fixed to an inner peripheral portion of a tip end of the valve housing 314. The valve 303 is reciprocatably held between the valve seat 314S and the valve stopper S0. A valve biasing spring S4 is disposed between the valve 303 and the valve stopper S0, the valve 303 being urged by the valve biasing spring S4 in a direction in which the valve 303 moves farther away from the valve stopper S0.

Although the valve 303 and the tip end of the plunger rod 301 are urged in the opposite directions to each other by means of the individual springs, since the plunger rod biasing spring 302 has a stronger spring, the plunger rod 301 pushes the valve 303 in a direction in which the valve 303 moves farther away from the valve seat against the biasing force given by the valve biasing spring S4. As a result, the valve 303 is pressed toward the valve stopper S0.

Therefore, when the electromagnetically driven intake valve mechanism 300 is in the OFF state (when the electromagnetic coil 304 is not energized), the plunger rod 301 is urged in a direction to open the valve 303 via the plunger rod 301 with the plunger rod biasing spring 302. Therefore, when the electromagnetically driven intake valve mechanism 300 is in the OFF state, the plunger rod 301 and the valve 303 are maintained in a valve opening position.

A discharge valve unit 8 is provided at the outlet of the compression chamber 11 (see FIG. 2). The discharge valve unit 8 includes a discharge valve seat 8*a*, a discharge valve 8*b* coming into contact with and moving away from the discharge valve seat 8*a*, a discharge valve spring 8*c* biasing the discharge valve 8*b* toward the discharge valve seat 8*a*, and a discharge valve holder 8*d* accommodating the discharge valve 8*b* and the discharge valve seat 8*a*.

Inside of the discharge valve holder 8*d*, a shouldered portion 8*f* forming a stopper for limiting the stroke of the discharge valve 8*b* is provided.

When there is no fuel differential pressure between the compression chamber 11 and the fuel discharge port 12, the discharge valve 8*b* is contact-bonded onto the discharge valve seat 8*a* by means of an biasing force caused by the discharge valve spring 8*c*, thereby the valve is closed. When the fuel pressure of the compression chamber 11 becomes larger than that of the fuel discharge port 12, the discharge valve 8*b* begins to resist the discharge valve spring 8*c*, thereby opening the valve, then, fuel in the compression chamber 11 is delivered under high pressure to a common rail, serving as a high-pressure capacity chamber 23, via the fuel discharge port 12. When the discharge valve 8*b* opens, it comes in contact with the discharge valve stopper 8*f*, resulting in the restriction of the stroke. Therefore, the stroke of the discharge valve 8*b* is properly determined by the discharge valve stopper 8*d*. If the stroke is too long, fuel delivered to the fuel discharge port 12 under high pressure is prevented from flowing back into the compression chamber 11 again due to the delay of closing the discharge valve 8*b*, so that a decrease in the efficiency of a high-pressure pump can be suppressed. Furthermore, when the discharge valve 8*b* repeatedly opens and closes, the discharge valve stopper 8*d* is guided by the inner peripheral surface so that the discharge valve 8*b* moves only in the direction of the stroke. This configuration enables the discharge valve unit 8 to function as a check valve which controls the direction of the fuel flow.

According to these configurations, the compression chamber 11 includes an electromagnetically driven intake valve mechanism 300, a discharge valve unit 8, a plunger 2, a cylinder 6, and a pump housing 1.

Fuel is directed from a fuel tank 20 to the low-pressure fuel port 10*a* of the pump by a low-pressure fuel supply pump 21 via an intake piping 28. At that time, the low-pressure fuel supply pump 21 regulates the pressure of intake fuel flowing into the pump housing 1 at a constant pressure on the basis of a signal from an engine controller unit 27 (hereinafter referred to as an ECU).

The high-pressure fuel compressed in the compression chamber is supplied to the high-pressure fuel capacity chamber 23 from the discharge port 12 via the route 1. The high-pressure fuel capacity chamber 23 is attached with a high-pressure fuel injection valve 24 and a pressure sensor 26. As many high-pressure fuel injection valves 24 as the number of cylinders of the internal combustion engine is provided, and the high-pressure fuel injection valve 24 is configured to inject fuel to the combustion chamber of the internal combustion engine on the basis of the signal from the ECU 27.

Figure 6A:
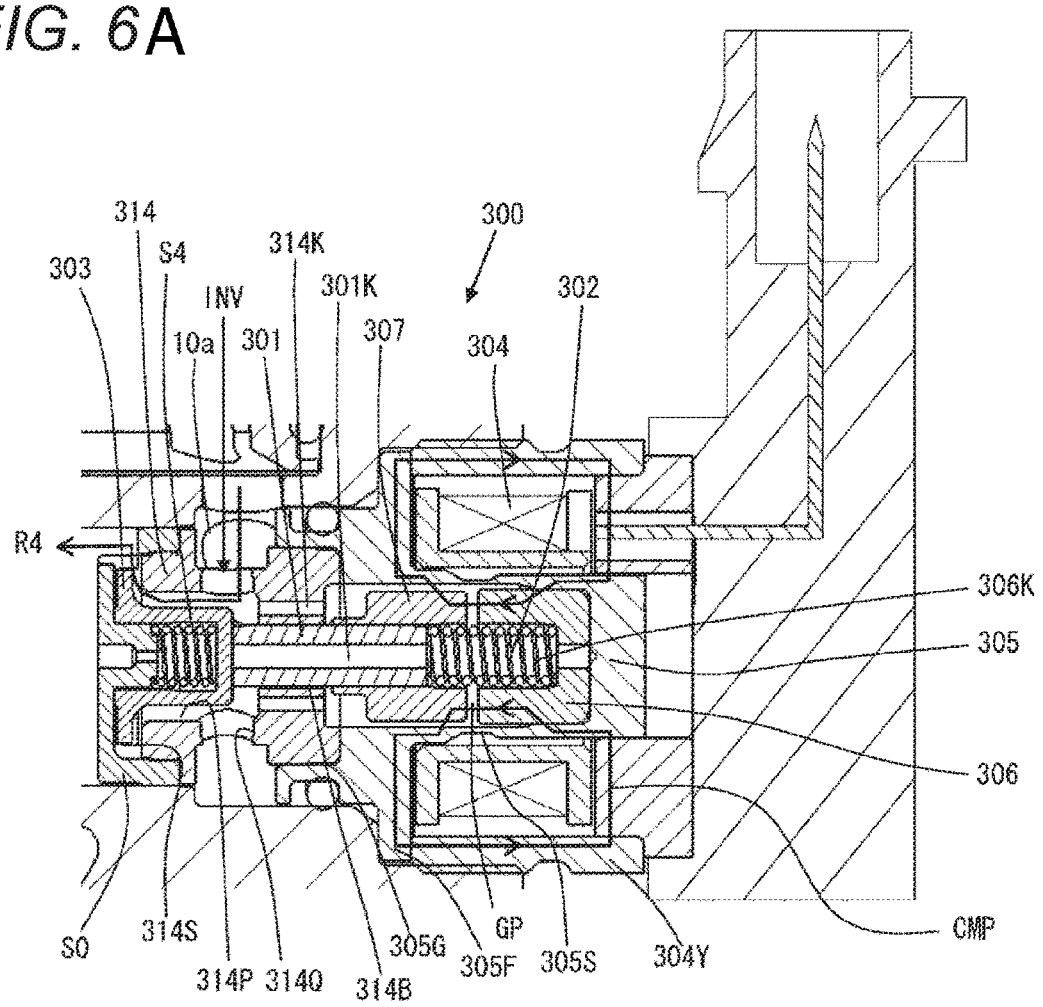
FIGS. 6A and 6B are figures for explaining an electromagnetically driven intake valve mechanism used for the first and the second embodiment in which the present invention is carried out.
Figure 6B:
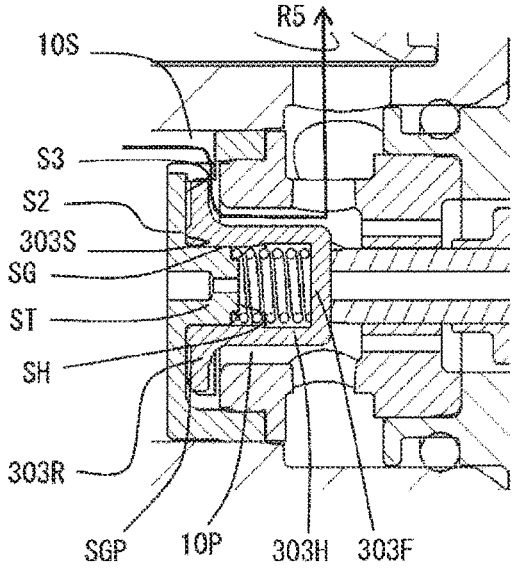

At the inner peripheral side of the coil 304 formed in an annular shape, the electromagnetically driven intake valve mechanism 300 includes a cup-shaped yoke 305 having a bottom also serving as a body of the electromagnetic driving mechanism unit. The yoke 305 includes a fixed core 306 and an anchor 307 on its inner peripheral portion in such a manner that the plunger rod biasing spring 302 is sandwiched between the fixed core 306 and the anchor 307. As illustrated in. FIGS. 6A and 6B in details, the fixed core 306 is rigidly fixed by press-fitting the bottom portion of the yoke 305. The anchor 307 is fixed by press-fitting the plunger rod 301 to the side opposite to the valve side end portion, and the anchor 307 faces the fixed core 306 with a magnetic gap GP interposed therebetween. The coil 304 accommodated in a cup-shaped side yoke 304Y, and both of them are fixed by press-fitting and engaging the inner peripheral surface of the open end portion of the side yoke 304Y with the external peripheral portion of the annular flange portion 305F of the yoke 305. A closed magnetic path CMP crossing the magnetic gap GP is formed around the coil 304 by the yoke 305, the side yoke 304Y, the fixed core 306, and the anchor 307. A portion of the yoke 305 facing the periphery of the magnetic gap GP is formed to have a thinner thickness, so that a magnetic diaphragm portion 305S is formed. Accordingly, the magnetic flux leaking through the yoke 305 is reduced, and the magnetic flux passing through the magnetic gap GP can be increased.

As illustrated in FIGS. 6A and 6B, a valve housing 314 having a bearing portion 314B is fixed by press-fitting in an inner peripheral portion of an open side end portion cylindrical portion 305G of the yoke 305, and the plunger rod 301 penetrates through this bearing 314B and extends to the valve 303 provided in the valve housing 314 at the opposite to an inner peripheral portion of a side end portion of the bearing 314B.

Between the tip of the plunger rod 301 and the valve stopper S0, the valve 303 is attached with the valve biasing spring S4 interposed therebetween so that the valve 303 can move reciprocally. A surface at one side of the valve 303 faces the valve seat 314S formed on the valve housing 314, and the surface at the other side has an annular face portion 303R facing the valve stopper S0. At the central portion of the annular face portion 303R, a cylindrical portion with a bottom is provided to extend to the tip of the plunger rod 301. The cylindrical portion having the bottom includes a bottom portion flat surface portion 303F and a cylindrical portion 303H. A cylindrical portion 303H passes through an opening 314P formed in the valve housing 314 inside of the valve seat 314S and extends to the inside of the low-pressure fuel port 10*a*.

The tip of the plunger rod 301 is in contact with the surface of the flat surface portion 303F of a plunger rod side end portion of the valve 303 in the low-pressure fuel port 10*a*. In the cylindrical portion between the bearing 314B and the opening 314P of the waive housing 314, four fuel communication holes 314Q are provided with an equal interval in the peripheral direction. The four fuel communication holes 314Q is in communication in the low-pressure fuel port 10*a* inside and outside of the valve housing 314. Between an outer peripheral surface of the cylindrical portion 303H and a peripheral surface of the opening 314P, a cylindrical fuel introduction path 10*p* connected to the annular fuel passage 105 between the valve seat 314S and the annular face portion 303R is formed.

The valve stopper S0 has at its central portion of the annular face portion S3 a projection ST having a cylindrical surface portion SG projecting to the bottomed cylindrical portion side of the valve 303, and the cylindrical surface portion SG functions as a guide portion guiding a stroke of the valve 303 in the axial direction.

The valve biasing spring S4 is retained between a valve end surface SH of the projection ST of the valve stopper S0 and the bottom face of the bottomed cylindrical portion of the valve 303.

In this embodiment, at an instance when the valve 303 opens, the plunger rod 301 is attracted in the right direction in the drawing with an electromagnetic force, and therefore, the tip of the plunger rod 301 moves away from the flat surface portion 303F of the valve 303, and a gap is formed therebetween. At this occasion, since the piston plunger 2 is moving upward from the bottom dead center, the pressure in the low-pressure fuel port 10*a* is as follows: fuel is refilled from the dumper chamber 10*d* and the low-pressure fuel port 10*a* in accordance with the increase of the capacity of the annular low-pressure chamber 10*f*, and accordingly, the pressure in the low-pressure fuel port 10*a* becomes lower in accordance with the refilling as compared with the pressure when the capacity of the tubular low-pressure chamber was decreasing. This reduced pressure also affects the area portion where the tip of the plunger 301 of the flat surface portion 303F of the valve 303 was in contact. Therefore, the pressure difference increases between the compression chamber side and the low-pressure chamber side, so that the close valve operation of the valve 303 is preformed more quickly.

<<Fuel Suction State>>

In an intake operation in which the piston plunger 2 moves downwardly from the top dead center position to the bottom dead center, the coil 304 is in a non-energized state. The plunger rod biasing spring 302 biases the plunger rod 301 toward the valve 303. Meanwhile, the valve biasing spring S4 biases the valve 303 toward the plunger rod 301. Since the biasing force of the plunger rod biasing spring 302 is set higher than the biasing force of the valve biasing spring S4, the biasing force of the springs at this time bias the valve 303 in the valve opening direction. The valve 303 is subjected to force in the valve opening direction as a consequence of a pressure difference between a static pressure of the fuel acting upon the outer surface of the valve 303 represented by the flat surface portion 303F of the valve 303 positioned in the low-pressure chamber 10*d* and a pressure of the fuel in the compression chamber. Further, fluid friction force generated between the fuel flow which flows into the compression chamber 11 along an arrow mark R4 through the fuel introduction path 10*p* and the peripheral surface of the cylindrical portion 303H of the valve 303 biases the valve 303 in the valve opening direction. Furthermore, a dynamic pressure of the fuel flow which passes the annular fuel passage 10S formed between the valve seat 314S and the annular face portion 303R of the valve 303 acts upon the annular face portion 303R of the valve 303 to bias the valve 303 in the valve opening direction. The valve 303 whose weight is several milligrams is opened quickly due to the biasing forces once the piston plunger 2 starts to move downwardly. The valve 303 thereafter strokes until it collides with the stopper ST.

At this time, since the peripheral region of the plunger rod 301 and the anchor 307 is filled with resident fuel, and friction force of the fuel with the bearing 314B is applied, and the stroke of the plunger rod 301 and the anchor 307 in the leftward direction in the figures slightly delays from the opening speed of the valve 303. As a result, a small gap is generated between the tip end face of the plunger rod 301 and the flat surface portion 303F of the valve 303. Consequently, the valve opening force applied from the plunger rod 301 drops for a moment. However, since the pressure of the fuel in the low-pressure chamber 10*d* is applied to the gap without a delay, the drop of the valve opening force applied from the plunger rod 301 (plunger rod biasing spring 302) is compensated for by the fluid force in the opening direction of the valve 303. Thus, at the time of opening of the valve 303, the static pressure and the dynamic pressure of the fluid act upon the entire surface of the valve 303 at the side of the low pressure fuel chamber 10*d*, and consequently, the valve opening speed is accelerated.

At the time of opening of the valve 303, the inner peripheral surface of the cylindrical portion 303H of the valve 303 is guided by the valve guide formed from the cylindrical surface SG of the projection ST of the valve stopper S0. The valve 303 smoothly strokes without being displaced in a diametrical direction. The cylindrical surface SG which forms the valve guide is formed across the upstream side and the downstream side across the surface on which the valve seat 314 is formed. Therefore, not only the stroke of the valve 303 can be sufficiently supported, but also the dead space at the inner periphery side of the valve 303 can be utilized effectively. Therefore, the dimension of the intake valve unit INV in the axial direction can be reduced.

The valve biasing spring S4 is installed between the valve end surface SH of the valve stopper S0 and the bottom face portion at the side of the valve stopper S0 of the flat surface portion 303F of the valve 303. While the passage area of the fuel introduction path 10*p* formed between the opening 314P and the cylindrical portion 303H of the valve can assured sufficiently, the valve 303 and the valve biasing spring S4 can be disposed on the inner side of the opening 314P. Since the valve biasing spring S4 can be disposed by effectively making use of the dead space at the inner periphery side of the valve 303 positioned on the inner side of the opening 314P which forms the fuel introduction path 10*p*, the dimension of the intake valve unit INV in the axial direction can be reduced.

The valve 303 has a valve guide (SG) at its central portion and has the annular projection 303S which contacts with the receiving face S2 for an annular face portion S3 of the valve stopper S0 immediately on the outer periphery of the valve guide (SG). Further, the valve seat 314S is formed at a position at the outer side in a diametrical direction with respect to the annular projection 303S, and the annular air gap SGP extends to a further outer side in the radial direction. Further, the annular projection 303S which contacts with the receiving face S2 of the stopper S0 is provided at the inner side of the valve seat 314S at the inner side of the annular air gap SGP.

Therefore, in a valve closing movement hereinafter described, it is possible to cause a fluid pressure at the compression chamber side to act upon the annular air gap SGP rapidly so as to raise the valve closing speed when the valve 303 is pressed toward the valve seat 314S.

<<Fuel Spilling State>>

The piston plunger 2 begins to move upwardly from the bottom dead center position to the top dead center. Since the coil 304 is in a non-energized state, part of the fuel once taken into the compression chamber 11 is spilled (spilt) into the low-pressure fuel port 10*a* through the annular fuel passage 10S and the fuel introduction path 10P. When the flow of the fuel in the annular fuel passage 10S changes over from the direction of the arrow mark R4 to the direction of the arrow mark R5, the flow of the fuel stops for a moment and the pressure in the annular air gap SGP rises. However, the plunger biasing spring 302 presses the valve 303 toward the stopper S0 at this time. Rather, the valve 303 is pressed firmly toward the stopper S0 by means of a fluid force for pressing the valve 303 toward the stopper S0 with the use of the dynamic pressure by the fuel flowing into the annular fuel passage 105 of the valve seat 314S and a fluid force for acting so as to attract the valve 303 and the stopper S0 to each other by means of the sucking effect of the fuel flow which flows along the outer periphery of the annular air gap SGP.

After a moment at which the flow stream changes over to the R5 direction, the fuel in the compression chamber 11 flows into the low-pressure fuel port 10*a* successively passing the annular fuel passage 10S and the fuel introduction path 10P. Here, the fuel flow path sectional area of the fuel passage 10S is set smaller than that of the fuel introduction path 10P. In other words, the fuel flow path sectional area is set smallest at the annular fuel passage 10S. Therefore, pressure loss is generated at the annular fuel passage 10S and the pressure in the compression chamber 11 begins to rise. However, the fluid pressure is received at the annular face of the stopper S0 at the compression chamber side and is less likely to act upon the valve 303.

<Fuel Discharging State>>

If the coil 304 is energized in accordance with an instruction from the engine controller unit ECU in the fuel spilling state described above, then a closed magnetic path CMP is created as depicted in FIGS. 6A and 6B. When the closed magnetic path CMP is formed, magnetic attractive force is generated between opposing faces of the fixed core 306 and the anchor 307 in the magnetic gap GP. This magnetic attractive force overcomes the biasing force of the plunger rod biasing spring 302 to attract the anchor 307 and the plunger rod 301 fixed to the anchor 307 toward the fixed core 305. At this time, the fuel in the magnetic gap GP and the storage chamber 306K for the plunger rod biasing spring 302 passes through the fuel passage 301K and the periphery of the anchor 307 and is discharged from the fuel passage 314K to the low pressure passage. Consequently, the anchor 307 and the plunger rod 301 are displaced to the side of the fixed core 306 smoothly. Once the anchor 307 is brought into contact the fixed core 306, the movement of the anchor 307 and the plunger rod 301 stops.

Since the plunger rod 301 is attracted to the fixed core 306 and the biasing force which biases the valve 303 to the stopper S0 side disappears, the valve 303 is urged in a direction where it moves farther away from the stopper S0 due to the biasing force given by the valve biasing spring S4. Accordingly, the valve 303 then begins its movement. At this time, the pressure in the annular air gap SGP positioned at the outer periphery side of the annular projection 303S becomes higher than the pressure at the side of the low-pressure fuel port 10*a* accompanied with the pressure rise in the compression chamber 11 thereby to assist the closing movement of the valve 303. The valve 303 is brought into contact the seat 314S to establish a valve closed state. As the piston plunger 2 consecutively moves upwardly, the volume of the compression chamber 11 decreases and the pressure in the compression chamber 11 increases. As a result, the discharge valve unit 8 discharges the high-pressure fuel.

At an instance at which the valve 303 comes into contact with the seat. 314S to assume a complete valve closed state, the plunger rod 301 is completely attracted toward the fixed core 306 and the tip of the plunger rod 301 is spaced apart from the end surface of the low-pressure fuel port 10*a* of the valve 303. With this arrangement as above, since the valve 303 does not accept a force applied in a valve closing direction by the plunger rod 301 during valve closing motion of the valve 303, the valve closing operation is made fast. In addition, since when the valve 303 performs the valve closing operation, the valve 303 does not strike against the plunger rod 301 and no striking sound is generated, a silent valve mechanism can be attained.

After the valve 303 is completely closed, the pressure in the compression chamber 11 is increased and a high pressure discharging is started, the electrical energization for the coil 304 is turned off. The magnetic attraction force generated between the opposing surfaces of the fixed core 306 and the anchor 307 is eliminated and the anchor 307 and the plunger rod 301 start to move toward the valve 303 side by the biasing force of the plunger rod biasing spring 302 and this motion is stopped when the plunger rod 301 is contacted with the bottom portion flat surface portion 303F of the valve 303. Since the valve closing force provided by the pressure in the compression chamber 11 is already sufficiently higher than the acting force of the plunger rod biasing spring 302, even if the plunger rod 301 pushes against the surface of the low-pressure port 10*a* of the valve 303, the valve 303 is not opened. This state becomes a preparing action in which the plunger rod 301 biases the valve 303 toward the valve opening direction at an instance when the piston plunger 2 is changed from the top dead center to the bottom dead center direction. The clearance between the plunger rod 301 and the end surface of the valve 303 is a very small air gap in an order of a several tens to several hundreds micron and the valve 303 is biased by the pressure in the compression chamber 11 and the valve 303 is a rigid member. Therefore, the striking sound generated when the plunger rod 301 strikes against the valve 303 does not become a noise because its frequency is higher than the audible frequency and its energy is also low.

Highly pressurized fuel can be adjusted by controlling a timing at which the coil 304 is electrically energized in response to an instruction from the engine controller unit ECU. If the electrical energization timing is controlled in such a way that the valve 303 performs a valve closing operation just after the piston plunger 2 is changed from the bottom dead center to the top dead center to perform a rising motion, then an amount of fuel spilled out is decreased and an amount of fuel discharged under high pressure is increased. If the electrical energization timing is controlled in such a way that the valve 303 performs a valve closing operation just before the piston plunger 2 is changed in operation from the top dead center to the bottom dead center to perform a descending operation, then an amount of spilled-out fuel is increased and an amount of fuel discharged in high pressure is reduced.

Since the fuel goes in and out always from the intake path 30*a* (low-pressure chamber 10*d*) during the three steps of the intake step, the returning step, and the discharging step described above, periodic pulsation is generated in the fuel pressure. The pressure pulsation is absorbed and decreased by the pressure pulsation reducing mechanism 9, blocks the propagation of the pressure pulsation to the intake piping 28 from the low-pressure fuel supply pump 21 to the pump housing 1 to prevent the intake piping 28 from being broken and, simultaneously, and allows the fuel to be supplied to the compression chamber 11 at a stable fuel pressure. Since the low-pressure chamber 10*c* is connected to the low-pressure chamber 10*d*, the both surfaces of the pressure pulsation reducing mechanism 9 are coated with fuel, so that the pressure pulsation of the fuel is effectively inhibited.

The annular low-pressure chamber 10*f* as the fuel trap 67 exists between the lower end of the cylinder 6 and the plunger seal apparatus 13, and the annular low-pressure chamber 10*f* is connected to the low-pressure chamber 10*d* via the low-pressure chamber 10*d*, the low-pressure fuel passage 10*e*, the annular low-pressure passage 10*h*, and the groove 7 provided on the holder 7. When the plunger 2 repeats the sliding movement in the cylinder 6, a coupling portion between the large diameter portion 2*a* and the small diameter portion 2*b* repeats upward and downward movements in the annular low-pressure chamber 10*f* and the capacity of the annular low-pressure chamber 10*f* is changed. In the intake step, the capacity of the annular low-pressure chamber 10*f* is reduced and the fuel in the annular low-pressure chamber 10*f* flows to the low-pressure chamber 10*d* through a low-pressure passage 11*e*. In the returning step and the discharging step, the capacity of the annular low-pressure chamber 10*f* is increased and the fuel in low-pressure chamber 10*d* flows to the annular low-pressure chamber 10*f* through a low-pressure passage 11*e*.

When focusing on the low-pressure chamber 10*d*, the fuel flows from the low-pressure chamber 10*d* to the compression chamber 11 while the fuel flows from the annular low-pressure chamber 10*f* into the low-pressure chamber 10*d* in the intake step. In the returning step, the fuel flows from the compression chamber 11 into the low-pressure chamber 10*d*, while the fuel is flowed from the low-pressure chamber 10*d* to the annular low-pressure chamber 10*f*. In the discharging step, the fuel flows from the annular low-pressure chamber 10*f* into the low-pressure chamber 10*d*. In this manner, the annular low-pressure chamber 10*f* has a function to aid the fuel to go in and out from, the low-pressure chamber 10*d*, and hence has an effect of reducing the pressure pulsation of the fuel generated in the low-pressure chamber 10*d*.

As illustrated in FIG. 2, an upstream of the discharge valve unit 8 and the low-pressure chamber 10*d* at a downstream of the discharge valve unit 8 is connected according to the following route: a relief path 211, a relief path 210, a relief path 212, and the low-pressure chamber 10*d*, not shown. The relief path 210 has a relief path opening 210*c* different from the relief path 211. The flow of the fuel is limited to only one direction from the downstream of the discharge valve unit 8 to the low-pressure chamber 10*d*, and therefore, the relief valve mechanism 200 is inserted from the opening 210*c* into the relief path 210, and is press-fitted with the inner peripheral portion of the relief path 210 and the relief valve housing press fitting unit 206*a*.

When an abnormally high pressure in the high-pressure fuel capacity chamber 23 that occurs due to, e.g., a malfunction in high-pressure fuel injection apparatuses (23, 24, 30) supplying fuel to the engine and a malfunction of the ECU 27 and the like that control the high-pressure fuel supply pump and the like becomes equal to or more than a set valve opening pressure of the relief valve 202, the fuel passes from the downstream side of the discharge valve 8*b* to the relief path 211, and reaches the relief valve 202. Then, the fuel having passed through the relief valve 202 passes from a relief path 208 made in a relief spring adjuster 205 through the relief path 212, and released into the low-pressure chamber 10*d* which is a low-pressure portion. Therefore, high-pressure portions such as the high-pressure fuel capacity chamber 23 are protected.

Hereinafter, the relief valve mechanism 200 will be explained. The relief valve 202 is pressed against the relief valve seat 201 by a relief spring 204 generating a pressing force, and the set valve opening pressure is set so that when the pressure difference between the inside of the intake chamber and the inside of the relief path becomes equal to or more than a predetermined pressure, the relief valve 202 moves away from the relief valve seat 201 to open the valve. In this case, a pressure at which the relief valve 202 begins to open is defined as the set valve opening pressure.

The relief valve mechanism 200 includes a relief valve housing 206 integrally formed with the relief valve seat 201, the relief valve 202, a relief retainer 203, the relief spring 204, and the relief spring adjuster 205. The relief valve mechanism 200 is assembled as a sub-assembly outside of the pump housing 1, and thereafter, fixed with the pump housing 1 by press fitting. The press fitting position is the inner peripheral portion of the relief path 210 and the relief valve housing press fitting unit 206*a*.

First, the relief valve 202, the relief retainer 203, and the relief spring 204 are inserted in this order into the relief valve housing 206, and the relief spring adjuster 205 is press-fitted and fixed to the relief valve housing 206. With the fixing position of this relief spring adjuster 205, a set load of the relief spring 204 is determined. The valve opening pressure of the relief valve 202 is determined by the set load of the relief spring 204.

The relief valve mechanism 200 thus assembled and made into a unit is inserted into the relief path 210 provided in the pump housing 1 in order to insert the relief valve mechanism 200. At this occasion, the relief valve mechanism 200 is inserted until the output side comes into contact with a shoulder 210*b*, and the relief valve housing 206*a* is press fitted in the relief path 210, so that it is fixed. At this occasion, the relief valve mechanism 200 is inserted from the output side of the relief valve mechanism 200. The press fitting unit has a function of preventing the high-pressure fuel at the downstream of the discharge valve unit 8 from flowing to the relief path 212. In the opening 210*c*, the seal member 207 is fixed to the opening 210*c* with a screw portion 213, and a seat surface 207*a* of a seal member and a seat surface 210*a* of a relief path opening are crimped with a thrust of a screw, and so that the high-pressure fuel is sealed from the outside.

As described above, the relief valve mechanism is provided inside of the relief path 210, and the inlet side of the relief valve mechanism 200 is at the downstream side of the discharge valve unit 8 and is therefore at a high pressure, and the output side thereof is at an upstream side of the discharge valve unit 8 and is therefore at a low pressure. Therefore, with a differential pressure between the high pressure at the inlet side of the relief valve mechanism 200 and a low pressure at the output side thereof, a force exerted from the inlet side of the relief valve mechanism 200 to the output side is generated. In the present embodiment, the output side of the relief valve mechanism 200 is the same direction as the insertion direction, and therefore, the relief valve mechanism 200 is in contact with the shoulder 210*b* of the relief path 210, and the shoulder 210*b* serves as a stopper, and therefore, it is not detached, so that the relief valve mechanism 200 does not come into contact with the seal member 207 to reduce the contact pressure between the seal member seat surface 207*a* and the seat surface 210*a* of the relief path opening, and the reliability of the seal property with the seal member 207 can be enhanced.

The plunger 2 and the cylinder 6 repeat the sliding movement while the internal combustion engine is operated. The outer shape of the large-diameter portion 2*a* of the plunger 2 as the sliding portion and the inner diameter of the cylinder 6 are set to define a clearance (gap) on the order of, for example, 8 to 10 μm. Normally, the clearance is filled with the fuel in the form of a thin film, whereby a smooth sliding movement is secured. When the thin film of the fuel is discontinued for any reason, the plunger 2 and the cylinder 6 are locked during the sliding movement and are secured, so that a problem that the fuel cannot be compressed to a high pressure occurs. In a state in which the high-pressure fuel supply pump compresses the fuel to a high pressure and discharges the same, the pressure of the fuel in the compression chamber 11 is increased, and a significantly minute high-pressure fuel can easily be pumped to the annular low-pressure chamber 10*f* through the clearance. Therefore, the discontinuity of the thin film of the fuel can hardly occurs. Heat generated by the sliding movement of the plunger 2 and the cylinder 6 is taken away to the outside of the high-pressure fuel supply pump by the compressed high-pressure fuel. Therefore, the thin film discontinuity caused by evaporation of the thin film of the fuel during the clearance due to the temperature rise does not occur.

In the present embodiment, a structure is employed so that the seat surface 207*a* of the seal member and the seat surface 210*a* of the relief path is bonded with metal crimping, and the relief path opening 210*c* is sealed, but the seal structure may also be such that the seal member 207 and the relief path opening 210*c* are welded, or a gasket is inserted to the relief path opening 210*c* and sealing may be accomplished by crimping with metal.

Second Embodiment

Figure 7:
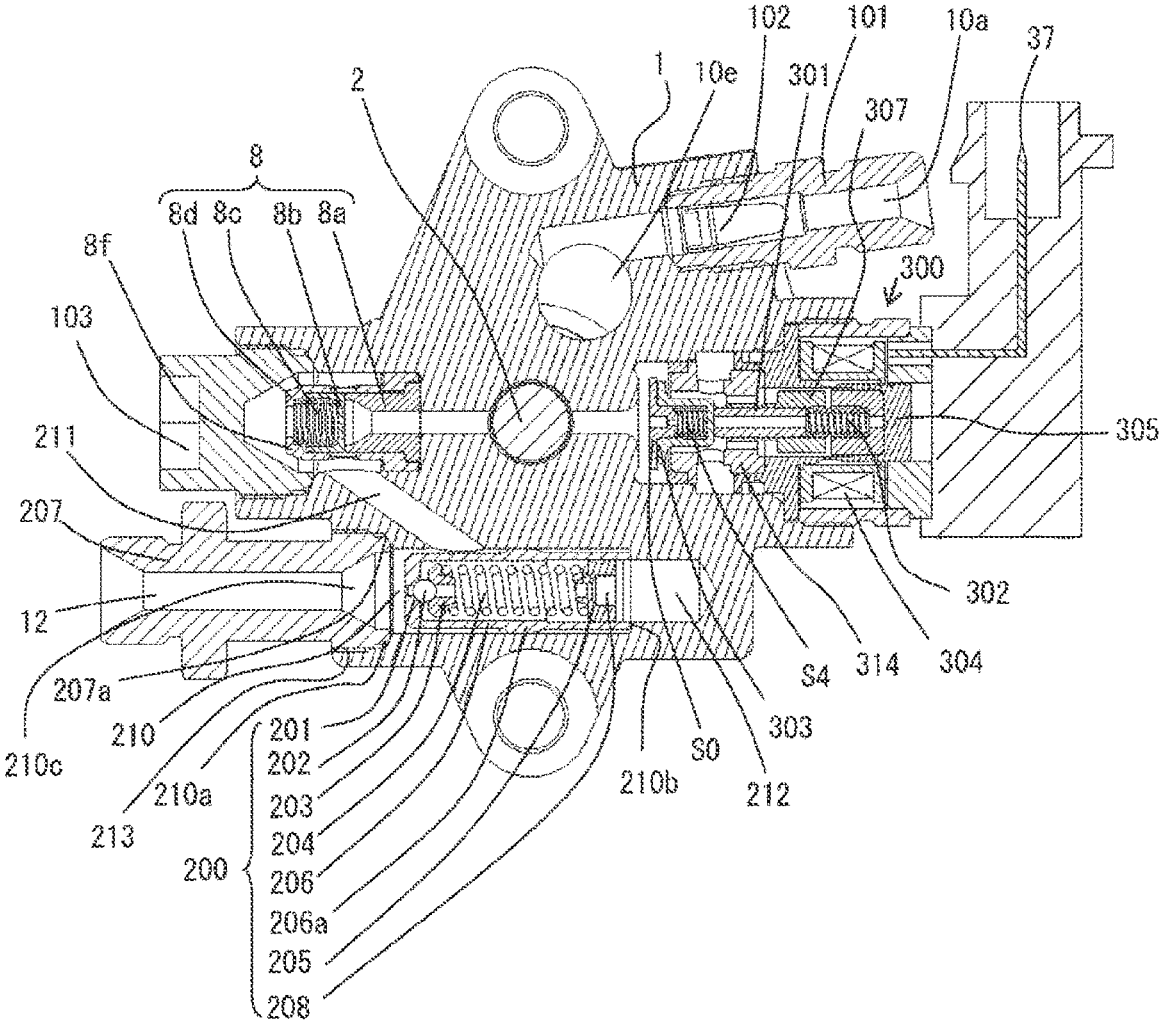
FIG. 7 is a transverse sectional view illustrating a high-pressure fuel supply pump according to the second embodiment in which the present invention is carried out.

The second embodiment will be explained with reference to FIG. 7.

The second embodiment is different from the first embodiment in that a fuel discharge port 12 is provided in the seal member 207, and the seal member 207 has a function of discharging high-pressure fuel and a fuel seal function. A joint 103 does not have any fuel discharge port 12, and in order to insert the discharge valve unit 8, the insertion port provided in the pump housing 1 is plugged, and only the function of sealing fuel is provided. The configuration other than the above is the same as the first embodiment. According to the present embodiment, the flexibility in the layout of the fuel discharge port 12 is increased, and the ease of attachment of the high-pressure fuel supply pump to the engine is improved.

Third Embodiment

In the first embodiment and the second embodiment, the high-pressure fuel supply pump in which the relief path 212 is connected to the compression chamber 11. The third embodiment is different from the first embodiment and the second embodiment in that, when an abnormally high pressure of piping and the like occurs, the high-pressure fuel passes through the relief path 212 from the downstream side of the discharge valve unit 8, and is released to the compression chamber 11. The configuration other than the above is the same as the first embodiment and the second embodiment. According to the present embodiment, the flexibility in terms of processing of the relief path 212 can be enhanced.

REFERENCE SIGNS LIST

1 pump housing
2 plunger
2*a* large diameter portion
2*b* small diameter portion
3 tappet
5 cam
6 cylinder
7 holder
8 discharge valve mechanism
9 pressure pulsation reducing mechanism
10*a* low-pressure fuel port
10*c*, 10*d* low-pressure chamber
10*e* low-pressure fuel passage
10*f* annular low-pressure chamber
11 compression chamber
12 discharge port
13 plunge seal apparatus
20 fuel tank
21 low-pressure fuel supply pump
23 high-pressure fuel capacity chamber
24 high-pressure fuel injection valve
26 sensor
27 engine controller unit (ECU)
200 relief valve mechanism
300 electromagnetically driven intake valve mechanism.

The invention claimed is:

1. A fuel pump comprising:
an electromagnetically driven intake valve mechanism that includes a plunger rod;
a pump housing formed with a discharge path in communication with a compression chamber;
a discharge valve arranged in the discharge path;
an opening formed in the pump housing in which a relief valve mechanism is arranged;
a seal member closing an open end of the opening;
a first relief passage communicating a downstream side of the discharge valve with the opening; wherein
the relief valve mechanism has a relief valve, a relief valve seat contacting the relief valve when the relief valve is closed and a relief spring biasing the relief valve against the relief valve seat,
a second relief passage communicating the first relief passage and a hole formed in the relief valve seat is formed between the seal member and the relief valve seat, and
the relief valve seat, the relief valve, and the relief spring are arranged in this order beginning from an open end side.

2. The fuel pump according to claim 1, wherein the opening of the pump body has a bottom formed by the pump body, and
the relief valve seat, the relief valve, the relief spring and the bottom of the opening are arranged in this order beginning from the open end side.

3. The fuel pump according to claim 1, wherein a longitudinal axis of the plunger rod is coincident with a longitudinal axis of the discharge path.

4. The fuel pump according to claim 3, wherein
in a horizontal cross section, the relief valve mechanism is arranged on one side with respect to an axis including the two longitudinal axes, and
an intake joint through which a low-pressure fuel flows is arranged on the other side with respect to the axis.

5. The fuel pump according to claim 4, wherein a low-pressure passage communicating a low-pressure fuel port of the intake joint and a low-pressure chamber in which a pressure pulsation reducing mechanism is provided is arranged on the other side with respect to the longitudinal axis.

* * * * *